US007534952B2

(12) United States Patent
Yamauchi

(10) Patent No.: US 7,534,952 B2
(45) Date of Patent: May 19, 2009

(54) PERFORMANCE DATA PROCESSING APPARATUS AND PROGRAM

(75) Inventor: Akira Yamauchi, Hamamatsu (JP)

(73) Assignee: Yamaha Corporation, Hamamatsu-Shi (JP)

( * ) Notice: Subject to any disclaimer, the term of this patent is extended or adjusted under 35 U.S.C. 154(b) by 298 days.

(21) Appl. No.: 10/946,736

(22) Filed: Sep. 21, 2004

(65) Prior Publication Data

US 2005/0061141 A1 Mar. 24, 2005

(30) Foreign Application Priority Data

Sep. 24, 2003 (JP) ..... 2003-331928

(51) Int. Cl.
*G10H 7/00* (2006.01)

(52) U.S. Cl. ..... 84/622; 84/659

(58) Field of Classification Search ..... 84/622, 84/659, 692

See application file for complete search history.

(56) References Cited

U.S. PATENT DOCUMENTS 5,726,371 A * 3/1998 Shiba et al. ..... 84/603
5,750,914 A * 5/1998 Takahashi ..... 84/626
6,281,420 B1 * 8/2001 Suzuki et al. ..... 84/477 R
6,284,964 B1 * 9/2001 Suzuki et al. ..... 84/626
6,476,307 B2 * 11/2002 Hikawa ..... 84/609
6,486,388 B2 * 11/2002 Akahori ..... 84/478
6,570,081 B1 5/2003 Suzuki et al.
6,703,549 B1 * 3/2004 Nishimoto et al. ..... 84/609
6,727,420 B2 * 4/2004 Suzuki et al. ..... 84/604
6,969,798 B2 * 11/2005 Iwase ..... 84/626
7,194,686 B1 * 3/2007 Suzuki et al. ..... 715/716

(Continued)

FOREIGN PATENT DOCUMENTS

JP 10-049161 2/1998

(Continued)

OTHER PUBLICATIONS

Notice of Grounds for Rejection (Office Action) re Japanese Patent Application No. 2007-121324, mailed Sep. 16, 2008.

*Primary Examiner*—David S. Warren
(74) *Attorney, Agent, or Firm*—Morrison & Foerster LLP

(57) ABSTRACT

Special-type tone generators are capable of tone generation corresponding to rendition-style designating data, while ordinary-type tone generators are incapable of such tone generation corresponding to rendition-style designating data. When performance data for the ordinary-type tone generator are acquired in a case where the special-type tone generator can be used, presence of a predetermined rendition style is detected on the basis of various control data included in the performance data, the control data in a portion of the performance data, corresponding to the predetermined rendition style, is converted into simple data that does not represent the predetermined rendition style, and also rendition-style designating data specifying the predetermined rendition style is added. In this way, the acquired performance data are reformed into performance data for the special-type tone generator. Conversely, when performance data for the special-type tone generator are acquired in a case where the special-type tone generator can not be used, rendition-style designating data is deleted from the acquired performance data, and tone control data is added, in place of the rendition-style designating data, so as to achieve a desired rendition style. In this way, the acquired performance data are reformed into performance data for the ordinary-type tone generator.

17 Claims, 6 Drawing Sheets

U.S. PATENT DOCUMENTS

| | | | | |
|---|---|---|---|---|
| 7,253,351 | B2 * | 8/2007 | Aoki et al. | 84/600 |
| 7,301,091 | B2 * | 11/2007 | Aoki et al. | 84/600 |
| 2003/0131716 | A1 * | 7/2003 | Aoki et al. | 84/610 |
| 2003/0145713 | A1 * | 8/2003 | Iwase | 84/626 |
| 2003/0172799 | A1 | 9/2003 | Sakurai et al. | |
| 2004/0094017 | A1 * | 5/2004 | Suzuki et al. | 84/609 |
| 2005/0235810 | A1 * | 10/2005 | Aoki et al. | 84/610 |
| 2005/0241464 | A1 * | 11/2005 | Aoki et al. | 84/610 |

FOREIGN PATENT DOCUMENTS

| | | |
|---|---|---|
| JP | 10074081 | 3/1998 |
| JP | 10-214083 | 8/1998 |
| JP | 2000-003175 | 1/2000 |
| JP | 2001-092451 | 4/2001 |
| JP | 2001-159892 | 6/2001 |
| JP | 2003-263159 | 9/2003 |

* cited by examiner

PERFORMANCE DATA PROCESSING APPARATUS AND PROGRAM

BACKGROUND OF THE INVENTION

The present invention relates generally to performance data processing apparatus and programs for generating performance data corresponding to predetermined types of tone generators. More particularly, the present invention relates to an improved performance data processing apparatus and program which are arranged to automatically convert performance data corresponding to one tone generator to thereby automatically generate performance data corresponding to another tone generator where tone colors (i.e., rendition styles) are allocated in a different manner from the one tone generator, i.e. which differs from the one tone generator in the way of allocating tone colors (i.e., rendition styles).

Generally, tone generators are used to automatically perform tones of desired tone colors on the basis of performance data. Recently, there have appeared tone generators that differ in the way of allocating tone colors (rendition styles). For example, some of the recent tone generators are arranged to reproduce given rendition styles, representative of various musical expressions and renditions characteristic of a musical instrument used, by addition of one or more kinds of control data to performance data including note-on data and note-off data (for convenience, such tone generators will hereinafter be referred to as "ordinary-type tone generators"), and others of the recent tone generators are arranged to reproduce musical expressions, corresponding to specific rendition styles, on the basis of only note-on instructions (for convenience, such tone generators will hereinafter be referred to as "rendition-style-compliant tone generators"). As one type of the rendition-style-compliant tone generators, there have been known special-type tone generators which are equipped with special-type tone colors, such as rendition-style-dependent tone colors, having different characteristics from ordinary-type tone colors; note that the rendition-style-dependent tone colors are tone colors corresponding to different rendition styles of a musical instrument, such as a steel guitar or electric bass guitar. The special-type tone generator disclosed in U.S. Application Publication No. U.S.2003/0172799A1 corresponding to Japanese Patent Application Laid-open Publication No. 2003-263159 has, in a map of a tone color, different special-type tone colors (rendition styles) allocated in a velocity direction and note number direction. Unlike the ordinary-type tone generators, the disclosed special-type tone color can make tone color changes (rendition style changes) using velocities and note numbers included in note-on data and note-off data of performance data. Thus, using such a rendition-style-compliant tone generator, it is possible to reproduce realistic musical expressions, based on given rendition styles, with high quality and execute an automatic performance with a variety of tone colors through very simple control.

As noted above, the ordinary-type tone generators and the rendition-style-compliant tone generators (e.g., the above-discussed special-type tone color) differ from each other in the way of allocating tone colors, and thus the way of using velocities and note numbers (namely, how to designate tone colors) significantly differs between the performance data usable by the ordinary-type tone generators and the performance data usable the rendition-style-compliant tone generators. Therefore, there is a need to generate performance data for each of the types of tone generators in accordance with the particular way of using velocities and note numbers. Thus, in a case where an ordinary-type tone generator has been replaced with (i.e., changed over to) a rendition-style-compliant tone generator or vice versa, and if the performance data that were used by the previous (i.e., replaced) tone generator before the tone generator changeover are used as-is in the new (i.e., replacing) tone generator, there would occur significant musical inconveniences; therefore, the performance data for the previous tone generator can not be used in the new tone generator. In other words, there is no compatibility between the performance data for the ordinary-type tone generators and the performance data for the rendition-style-compliant tone generators. Generally, it is quite time-consuming and cumbersome for a user to newly create performance data, from the beginning of the performance, for each tone generator to be used, each time a changeover is made from an ordinary-type tone generator to a rendition-style-compliant tone generator or vice versa. Further, if the user does not have sufficient musical knowledge and knowledge about differences in characteristic between individual musical instruments, it would be very difficult to create performance data for executing a tone performance with desired rendition styles reflected therein.

SUMMARY OF THE INVENTION

In view of the foregoing, it is an object of the present invention to provide an improved performance data processing apparatus and program which, when a changeover is made between tone generators differing from each other in the way of allocating tone colors (rendition styles), automatically convert performance data, previously used by the previous (or replaced) tone generator before the tone generator changeover, to thereby automatically create performance data corresponding to the new (or replacing) tone generator to be used after the tone generator changeover.

According to a first aspect of the present invention, there is provided an improved performance data processing apparatus, which comprises: a performance data acquisition section that acquires performance data of a first type including one or more kinds of tone control data, the performance data of the first type having a data structure predefined for use in a first-type tone generator; a detection section that detects presence of a predetermined rendition style on the basis of the control data included in the performance data of the first type acquired by the performance data acquisition section; and a data conversion section that converts the control data in the performance data of the first type, related to the predetermined rendition style detected by the detection section, into data including rendition-style designating data specifying the detected predetermined rendition style and thereby reforms the performance data of the first type as performance data of a second type including the converted rendition-style designating data, the performance data of the second type having a data structure predefined for use in a second-type tone generator.

According to the first aspect of the present invention, the first-type tone generator is an ordinary-type tone generator which is incapable of tone generation corresponding to rendition-style designating data, while the second-type tone generator is a special-type tone generator which is capable of such tone generation corresponding to rendition-style designating data. When performance data of the first type are acquired for reproduction of a music performance in a case where the second-type (special-type) tone generator can be used, it is preferable that the acquired performance data be converted into performance data of the second type and the second-type (special-type) tone generator generate tones in accordance with the converted performance data. The performance data processing apparatus according to the first aspect of the present invention can be suitably used for such purposes. Namely, presence of a predetermined rendition style (such as a vibrato rendition style) is detected on the basis of control data (e.g., data indicative of tone pitches) included in the acquired performance data of the first type. For example, in a portion of the performance data of the first type where the tone pitch varies over time, that portion is detected as representing a vibrato rendition style. The performance data of the second type may include rendition-style designating data (such as vibrato-rendition-style designating data) instructing the predetermined rendition style (such as a vibrato rendition style). In accordance with the rendition-style designating data, the second-type tone generator can generate a tone of the predetermined rendition style with high quality, utilizing, for example, a high-quality rendition style waveform (e.g., vibrato rendition style waveform). In the first aspect, the data conversion section converts the control data in the performance data of the first type, related to the predetermined rendition style detected by the detection section, into data including rendition-style designating data specifying the detected predetermined rendition style and thereby reforms the performance data of the first type as performance data of the second type including the converted rendition-style designating data. Thus, the user can readily acquire high-quality performance data of the second type for the second-type tone generator.

According to a second aspect of the present invention, there is provided a performance data processing apparatus, which comprises: a performance data acquisition section that acquires performance data of a first type including rendition-style designating data for specifying a predetermined rendition style, the performance data of the first type having a data structure predefined for use in a first-type tone generator; a detection section that detects the rendition-style designating data included in the performance data of the first type acquired by the performance data acquisition section; and a data conversion section that converts the rendition-style designating data, detected by the detection section, into one or more kinds of tone control data to be used for reproducing the predetermined rendition style specified by the rendition-style designating data and thereby reforms the performance data of the first type as performance data of a second type including the converted one or more kinds of tone control data, the performance data of the second type having a data structure predefined for use in a second-type tone generator.

According to the second aspect of the present invention, the first-type tone generator is a special-type tone generator which is capable of tone generation corresponding to rendition-style designating data, while the second-type tone generator is an ordinary-type tone generator which is incapable of such tone generation corresponding to rendition-style designating data. When performance data of the first type are acquired for reproduction of a music performance in a case where the first-type (special-type) tone generator can not be used, the acquired performance data have to be converted into performance data of the second type, and the second-type (ordinary-type) tone generator has to generate tones in accordance with the converted performance data of the second type. The performance data processing apparatus according to the second aspect of the present invention can be suitably used for such purposes. Namely, it is determined whether the acquired performance data of the first type include rendition-style designating data specifying a predetermined rendition style (such as a vibrato rendition style), and, if so, the rendition-style designating data is converted into one or more kinds of tone control data to be used for reproducing the predetermined rendition style specified by the rendition-style designating data and thereby reforms the performance data of the first type as performance data of the second type including the converted one or more kinds of tone control data. For example, if the rendition-style designating data designates a vibrato rendition style, the second-type tone generator generates tone pitch data varying over time in a vibrato style, and creates performance data of the second type including such time-varying tone pitch data. Thus, the user can readily acquire performance data of the second type for the second-type tone generator on the basis of the acquired high-quality performance data of the first type.

When a changeover is made between tone generators differing from each other in the way of allocating tone colors (rendition styles), the performance data processing apparatus of the present invention automatically converts performance data usable by the previous tone generator into performance data usable by the new tone generator to be employed after the changeover, so that the user can readily acquire performance data corresponding to the new tone generator without performing time-consuming and laborious operation.

The present invention may be constructed and implemented not only as the apparatus invention as discussed above but also as a method invention. Also, the present invention may be arranged and implemented as a software program for execution by a processor such as a computer or DSP, as well as a storage medium storing such a software program.

The following will describe embodiments of the present invention, but it should be appreciated that the present invention is not limited to the described embodiments and various modifications of the invention are possible without departing from the basic principles. The scope of the present invention is therefore to be determined solely by the appended claims.

BRIEF DESCRIPTION OF THE DRAWINGS

For better understanding of the object and other features of the present invention, its preferred embodiments will be described hereinbelow in greater detail with reference to the accompanying drawings, in which:

FIGS. 2A and 2B are conceptual diagrams showing an example of tone color vs. tone volume mapping for a special-type tone color, of which FIG. 2A shows allocation, to pitch names, of rendition-style-dependent tone colors while FIG. 2B shows allocation, to velocities, of rendition-style-dependent tone colors;

DETAILED DESCRIPTION OF THE EMBODIMENTS

Figure 1:
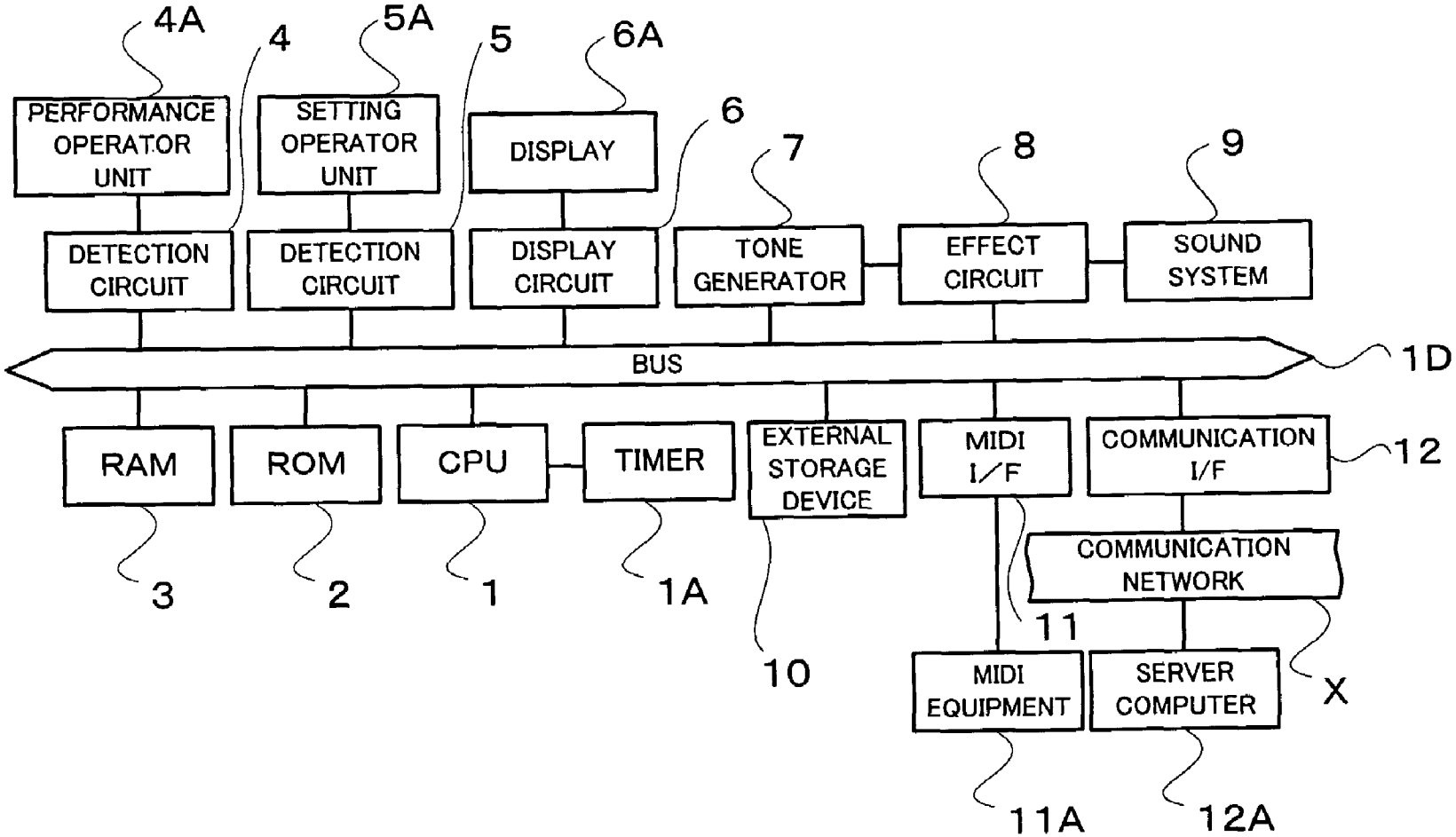
FIG. 1 is a block diagram illustrating a general hardware setup of an electronic musical instrument to which is applied a performance data processing apparatus in accordance with an embodiment of the present invention.

FIG. 1 is a block diagram illustrating a general hardware setup of an electronic musical instrument, to which is applied a performance data processing apparatus in accordance with an embodiment of the present invention. This electronic musical instrument is controlled by a microcomputer comprising a microprocessor unit (CPU) 1, a read-only memory (ROM) 2 and a random-access memory (RAM) 3. The CPU 1 controls behavior of the entire electronic musical instrument. To the CPU 1 are connected, via a data and address bus 1D, the ROM 2, RAM 3, detection circuits 4 and 5, display circuit 6, tone generator (T.G.) circuit 7, effect circuit 8, external storage device 10, MIDI interface (I/F) 11 and communication interface 12. Also connected to the CPU 1 is a timer 1A for counting various time periods and intervals, for example, to signal interrupt timing for timer interrupt processes. For example, the timer 1A generates clock pulses, which are given to the CPU 1 as processing timing instructions or as interrupt instructions. The CPU 1 carries out various processes in accordance with such instructions.

The ROM 2 has prestored therein various programs to be executed by the CPU 1 and various data. The RAM 3 is used as a working memory for temporarily storing various data generated as the CPU 1 executes a predetermined program, as a memory for storing the currently-executed program and data related thereto, and for various other purposes. Predetermined address regions of the RAM 3 are allocated to respective functions and used as registers, flags, tables, memories, etc. Performance operator unit 4A is, for example, a keyboard including a plurality of keys for designating pitches of tones to be generated and key switches corresponding to the keys. The performance operator unit 4A, such as a keyboard, can be used not only for a manual performance by a user, but also as an input means for entering automatic performance environments etc. into the apparatus. The detection circuit 4 is a performance operation detection means for detecting depression and release of the keys on the performance operator unit 4A to thereby produce performance detection outputs.

Setting operator unit 5A includes various switches and operators for inputting various information pertaining to an automatic performance. For example, the setting operator unit 5A includes switches and operators operable by the user to select a performance data set to be used for an automatic performance and set a performance environment, such as a performance tempo. In addition to the above-mentioned switches and operators, the setting operator unit 5A may include a numeric keypad for entry of numeric value data and a keyboard for entry of text and character data which are to be used for selecting, setting and controlling a tone pitch, tone color, effect, etc., and various other operators, such as a mouse for operating a predetermined pointing element displayed on a display device 6A that may be in the form of an LCD (Liquid Crystal Display) and/or CRT (Cathode Ray Tube). The detection circuit 5 constantly detects respective operational states of the individual operators on the setting operator unit 5A and outputs switch information, corresponding to the detected operational states of the operators, to the CPU 1 via the data and address bus 1D. The display circuit 6 visually displays not only various information related to an automatic performance, but also a controlling state of the CPU 1, etc. The user can, for example, select, enter and set a performance environment with reference to the various information displayed on the display device 6A.

The tone generator (T.G.) circuit 7, which is capable of simultaneously generating tone signals in a plurality of channels, receives, via the data and address bus 1D, various performance information generated in response to user's manipulation on the performance operator unit 4A or on the basis of performance data, and it generates tone signals based on the received performance information. Each of the tone signals thus generated by the tone generator circuit 7 is audibly reproduced or sounded by a sound system 9, including an amplifier and speaker, after being imparted with en effect via the effect circuit 8. The effect circuit 8 includes a plurality of effect units which can impart various different effects to the tone signals, generated by the tone generator circuit 7, in accordance with effect parameters set in a given manner. The tone generator circuit 7, effect circuit 8 and sound system 9 may be constructed in any conventionally known manner. For example, the tone generator circuit 7 may be either an ordinary-type tone generator or a special-type tone generator to be later described (see FIG. 2) which employs any of the conventionally-known tone signal synthesis methods, such as the FM, PCM, physical model and formant synthesis methods. Further, the tone generator circuit 7 may be implemented by either dedicated hardware or software processing performed by the CPU 1.

The external storage device 10 is provided for storing various data, such as performance data and waveform data corresponding to a plurality of special-type tone colors based on different rendition styles (i.e., rendition-style-dependent tone colors), and data related to control based on various control programs to be executed by the CPU 1. The external storage device 10 may includes a waveform memory (waveform ROM) for storing a plurality of sets of waveform data corresponding to special-type tone colors (i.e., rendition-style-dependent tone colors). Where a particular control program is not prestored in the ROM 2, the particular control program may be prestored in the external storage device (e.g., hard disk device) 10, so that, by reading the particular control program from the external storage device 10 into the RAM 3, the CPU 1 is allowed to operate in exactly the same way as in the case where the particular control program is stored in the ROM 2. This arrangement greatly facilitates version upgrade of the control program, addition of a new control program, etc. The external storage device 10 may comprise any of various removable-type media other than the hard disk (HD), such as a flexible disk (FD), compact disk (CD-ROM or CD-RAM), magneto-optical disk (MO) and digital versatile disk (DVD). Alternatively, the external storage device 10 may comprise a semiconductor memory, such as a flash memory.

The MIDI interface (I/F) 11 is an interface provided for receiving or delivering performance data of the MIDI format (i.e., MIDI data) from or to other MIDI equipment 11A or the like externally connected to the electronic musical instrument. Note that the other MIDI equipment 11A may be of any structural or operating type, such as the keyboard type, stringed instrument type, wind instrument type, percussion instrument type or body-attached type, as long as it can generate MIDI data in response to manipulations by the user. Also note that the MIDI interface 11 may be a general-purpose interface rather than a dedicated MIDI interface, such as RS-232C, USB (Universal Serial Bus) or IEEE1394, in which case other data than MIDI event data may be communicated at the same time. In the case where such a general-purpose interface as noted above is used as the MIDI interface 11, the other MIDI equipment 11A may be designed to be able to communicate other data than MIDI event data. Of course, the performance data handled in the present invention may be of any other data format than the MIDI format, in which case the MIDI interface 11 and other MIDI equipment 11A are constructed in conformity to the data format used.

The communication interface 12 is connected to a wired or wireless communication network X, such as a LAN (Local Area Network), the Internet or telephone line network, via which it may be connected to a desired sever computer 12A so as to input a control program and various data to the electronic musical instrument from the sever computer 12A. Thus, in a case where a particular control program and various data are not contained in the ROM 2 or external storage device (e.g., hard disk) 10, these control program and data can be downloaded from the server computer 12A via the communication interface 12. Such a communication interface 12 may be constructed to be capable of both wired and wireless communication rather than either one of the wired and wireless communication.

Further, in the above-described electronic musical instrument, the performance operator unit 4A may be of any other type than the keyboard instrument type, such as a stringed instrument type, wind instrument type or percussion instrument type. Furthermore, the electronic musical instrument is not limited to the type where the performance operator unit 4A, display device 6A, tone generator circuit 7, etc. are incorporated together as a unit within the musical instrument; for example, the electronic musical instrument may be constructed in such a manner that the above-mentioned components 4A, 6A, 7, etc. are provided separately and interconnected via communication facilities such as a MIDI interface, various networks and/or the like. Moreover, the performance data processing apparatus of the present invention may be applied to any desired type of equipment other than electronic musical instruments, such as personal computers, portable (hand-held) phones and other portable communication terminals, karaoke apparatus and game apparatus. In the case where the performance data processing apparatus of the present invention is applied to a portable communication terminal, the predetermined functions may be performed as a whole system, comprising the terminal and a server, by causing the server to perform part of the functions, rather than causing only the terminal performing all of the predetermined functions.

Now, with reference to FIG. 2, a description will be given about a plurality of special-type tone colors prestored, as examples of special-type tone generators, in the tone generator circuit 7, ROM 2, external storage device 10 or the like, which have different characteristics from ordinary-type tone colors that can be designated by bank select data and program change data included in performance data.

According to the instant embodiment, for each musical instrument playable with various different rendition styles, sets of waveform data, corresponding to a plurality of special-type tone colors (rendition-style-dependent tone colors), are stored, for one type of musical instrument tone color assigned a predetermined tone color number, in association with various values of velocity data and note number data. Such a feature will be described below in relation to an instrument tone color of a steel guitar.

Figure 2A:
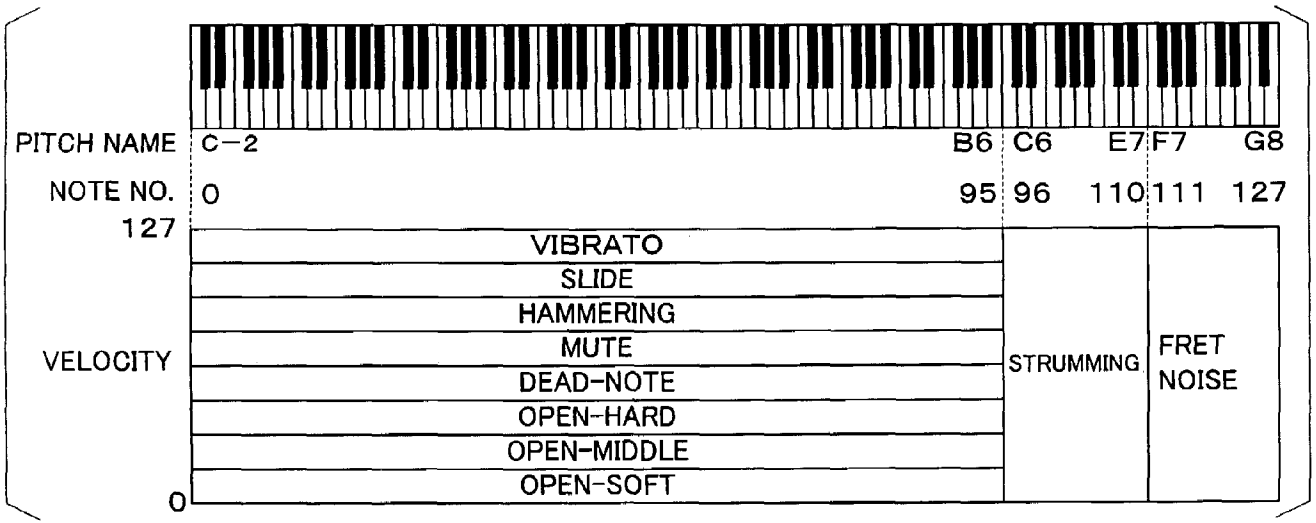
Figure 2B:
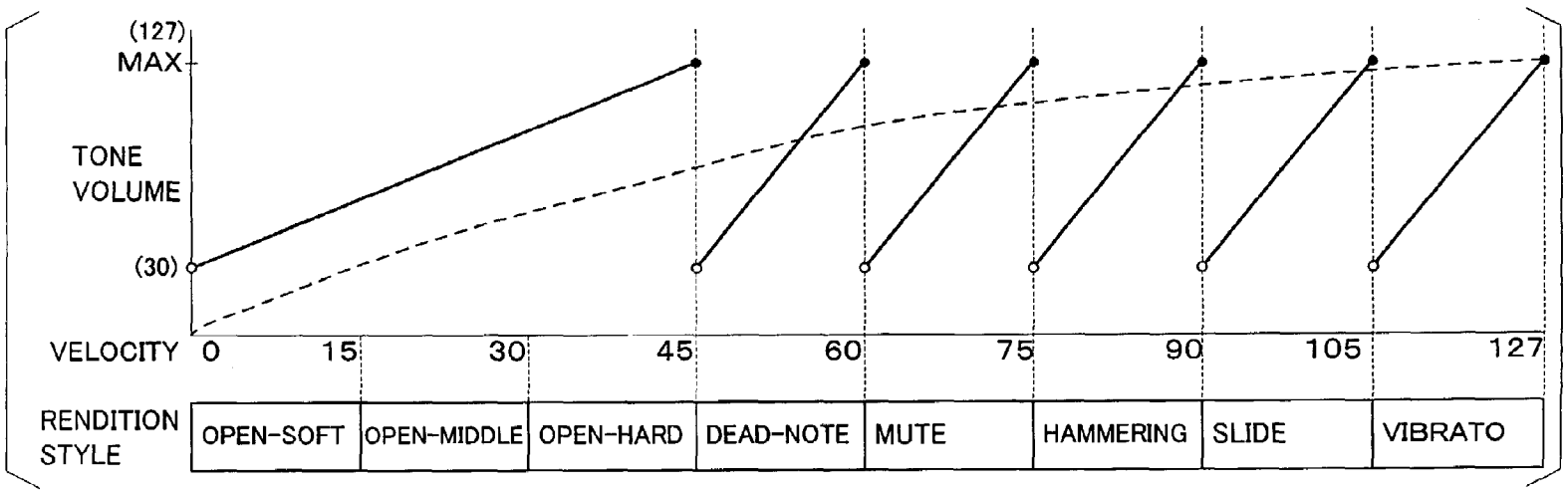

FIG. 2 conceptually shows an example of tone color vs. tone volume mapping for a special-type tone color. More specifically, FIG. 2A is a diagram showing allocation, to pitch names (note numbers), of the rendition-style-dependent tone colors belonging to the steel guitar tone color, and FIG. 2B is a diagram showing allocation, to velocities, of the rendition-style-dependent tone colors belonging to the steel guitar tone color. Note that the velocity data normally represents a larger tone volume of a tone signal as its value increases; in the instant embodiment, the velocity data value varies within a range of "0" to "127", but the velocity data value "0" has the same meaning as a "note-off" value. The note number data normally represents a higher pitch (higher-pitch name) of a tone signal as its value increases; in the instant embodiment, the note number data value varies within a range of "0" to "127". Here, the note number data value "0" corresponds to a pitch name "C-2", and the note number data value "127" corresponds to a pitch name "G8".

In the case of the steel guitar, eight types of rendition-style-dependent tone colors: "open-soft rendition style tone color"; "open-middle rendition style tone color"; "open-hard rendition style tone color"; "dead-note rendition style tone color"; "mute rendition style tone color"; "hammering rendition style tone color"; "slide rendition style tone color"; and "vibrato rendition style tone color", are allocated over a pitch range of C-2-B6 that correspond to note numbers "0"-"95", as shown in FIG. 2A. Further, these eight rendition-style-dependent tone colors are allocated to different value ranges of the velocity data. More specifically, as illustrated in FIG. 2B, the open-soft rendition style tone color is allocated to the velocity data value range of "1"-"15", the open-middle rendition style tone color allocated to the velocity data value range of "16"-"30", the open-hard rendition style tone color allocated to the velocity data value range of "31"-"45", the dead-note rendition style tone color allocated to the velocity data value range of "46"-"60", the mute rendition style tone color allocated to the velocity data value range of "61"-"75", the hammering rendition style tone color allocated to the velocity data value range of "76"-"90", the slide rendition style tone color allocated to the velocity data value range of "91"-"105", and the vibrato rendition style tone color allocated to the velocity data value range of "106"-"127".

Further, as seen in FIG. 2A, other rendition-style-dependent tone colors that do not relate to any specific tone pitch are allocated to a pitch range of C6-G8 (corresponding to note numbers "96"-"127") which is not used by an ordinary steel guitar, i.e. over which the ordinary steel guitar normally can not generate any tone. Namely, strumming rendition style tone colors are allocated to the range of C6-E7 corresponding to note numbers "96"-"110", and, more specifically, the strumming rendition style tone colors include a plurality of different strumming rendition style tone colors that are dependent on differences in stroke speed, position at which the left hand is used to mute, etc. These different strumming rendition style tone colors are allocated to different tone pitches within the C6-E7 range. Fret-noise rendition style tone colors are allocated to the pitch range of F7-G8 (corresponding to note numbers "111"-"127"). More specifically, the fret-noise rendition style tone colors include a plurality of fret-noise rendition style tone colors that correspond to a scratch sound produced by scratching a string with a finger or pick, a sound produced by hitting the body of the guitar, etc. These fret-noise rendition style tone colors are allocated to different tone pitches within the F7-G8 range.

Although a separate set of waveform data may be provided for each of the eight types of rendition-style-dependent tone colors allocated to the steel guitar pitch range of C-2-B6, a plurality of sets of sub waveform data are provided for each of the eight rendition-style-dependent tone colors in the instant embodiment. For example, one of the sets of sub waveform data is provided per predetermined pitch range, e.g. per half octave. In the described embodiment, the same sets of sub waveform data are provided for shared use among individual velocity data values; however, different sets of such sub waveform data may be provided for the individual velocity data values, i.e. the sub waveform data may be differentiated among the velocity data values.

Further, in the instant embodiment, one different set of waveform data is provided for each of the plurality of types of strumming rendition style tone colors and fret-noise rendition style tone colors allocated to the steel guitar pitch range of C6-G8. These sets of waveform data are also stored in the waveform memory. The same sets of waveform data corresponding to the plurality of types of strumming rendition style tone colors and fret-noise rendition style tone colors are provided, in the instant embodiment, for shared use among the individual velocity data values; however, different sets of waveform data may be provided for the individual velocity data values, i.e. the waveform data may be differentiated among the velocity data values.

Namely, in the case of an instrument tone color having rendition-style-dependent tone colors, such as the above-mentioned steel guitar tone color, the velocity data values "1"-"127" are allocated to the pitch range of C-2-B6 as selection information for selecting any desired one of the plurality of types of rendition-style-dependent tone colors. Thus, in the instant embodiment, the velocity data values can not be used for tone volume control directly as they are. On the other hand, a predetermined range of velocity data, including a plurality of different velocity data values, is allocated to each of the types of rendition-style-dependent tone colors as tone volume control information. Therefore, if the velocity data values of the predetermined ranges allocated to the individual types of rendition-style-dependent tone colors (horizontal axis) are converted into tone volume control values (vertical axis) with characteristics as depicted in solid lines of FIG. 2B, then the use of the velocity data can select or designate each individual rendition-style-dependent tone color and control the tone volume thereof. Namely, the special-type tone color will have a characteristic with which a predetermined musical element (tone color or tone volume) varies in an unsuccessive manner in accordance with a particular parameter (e.g., velocity). Broken line in FIG. 2B represents a characteristic of tone volume control for an ordinary-type tone color which utilizes the velocity data value varying within the range of "1"-"127". Namely, the ordinary-type tone color has the characteristic that a predetermined musical element (e.g., tone volume) varies in a successive manner in accordance with a particular parameter (e.g., velocity).

More specifically, in the case of the dead-note rendition style tone color of the steel guitar tone color shown in FIG. 2B, velocity data values in the "46"-"60" range are allocated to the rendition style tone color. Thus, if these velocity data values in the "46"-"60" range are converted into tone volume control values (vertical axis of FIG. 2B) that range from a relatively small predetermined value (e.g., about "30") to a relatively great predetermined value (e.g., about "127"), then the volume of a tone signal of the dead-note rendition style tone color can be varied from a relatively small predetermined value to a relatively great predetermined value, although the resolution is sacrificed or lowered. In the case of the mute rendition style tone color of the steel guitar tone color, velocity data values in the "61"-"75" range only have to be converted into tone volume control values that range from a relatively small predetermined value (e.g., about "30") to a relatively great predetermined value (e.g., about "127"), similarly to the above-described dead-note rendition style tone color. In a similar manner, the volume of a tone signal of each of the hammering, slide and vibrato rendition style tone colors of the steel guitar tone color can be controlled by conversion through the velocity data values, i.e. in accordance with velocity data values obtained by converting the volume of the tone signal of the rendition style tone color in question.

Further, in the instant embodiment, the remaining three rendition-style-dependent tone colors, i.e. the open-soft rendition style tone color, open-middle rendition style tone color and open-hard rendition style tone color, are classified according to the intensity with which to play the steel guitar using an ordinary rendition style; that is, it may be considered that the classification of these three rendition-style-dependent tone colors is based on a difference in tone volume of the ordinary-type tone color rather than the rendition-style-dependent tone color. These three rendition-style-dependent tone colors are very similar. Therefore, velocity data values in the "1"-"45" range, allocated to the three rendition-style-dependent tone colors, only have to be converted into tone volume control values that range from a relatively small predetermined value (e.g., about "30") to a relatively great predetermined value (e.g., about "127"). Although, in the illustrated example of FIG. 2B, the variation range of the converted tone volume control values (i.e., tone volume control values after the conversion) has been described as being the same for all of the above-mentioned rendition-style-dependent tone colors, the variation range of the converted tone volume control values may be differentiated among the rendition-style-dependent tone colors.

Figure 3:
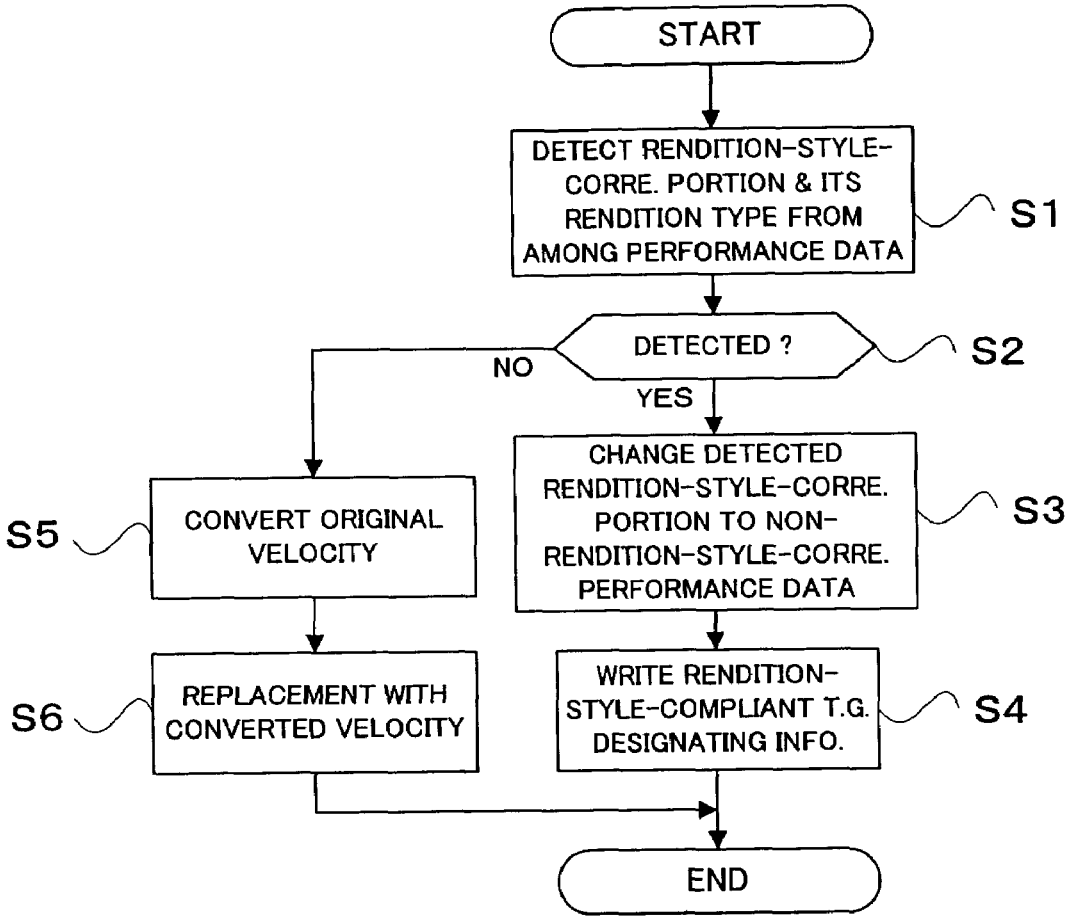
FIG. 3 is a flow chart showing an example of performance data creation processing performed when a tone generator to be used in the electronic musical instrument has been changed from an ordinary-type tone generator over to a rendition-style-compliant tone generator.
Figure 4:
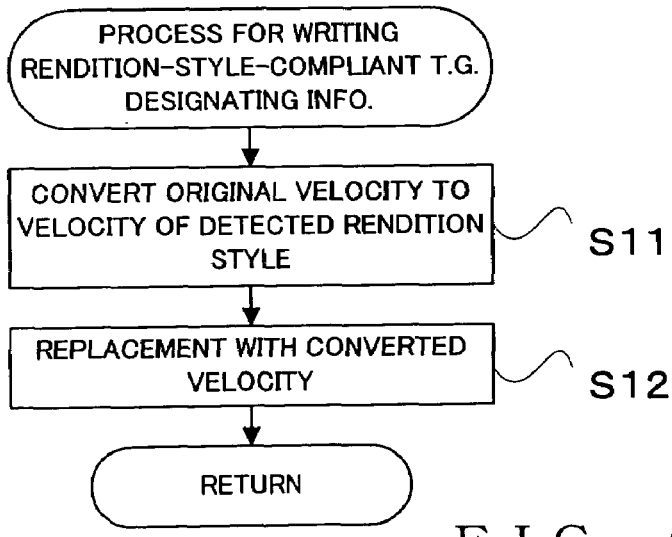
FIG. 4 is flow chart showing an example of a process for writing rendition-style-compliant tone generator designating information into performance data.

When the tone generator used in the electronic musical instrument employing the performance data processing apparatus is switched between an ordinary-type tone generator (T.G.) and a rendition-style-compliant tone generator (T.G.) having different characteristics, the electronic musical instrument performs "performance data creation processing" for automatically converting performance data used by the previous (replaced) tone generator before the tone generator changeover, so as to automatically create performance data corresponding to the new (replaced) tone generator to be used after the tone generator changeover. The following paragraphs describe the "performance data creation processing". FIG. 3 is a flow chart showing an example of the "performance data creation processing" performed when the tone generator in the electronic musical instrument has been changed from an ordinary-type tone generator over to a rendition-style-compliant tone generator. FIG. 4 is flow chart showing an example of a process for writing rendition-style-compliant tone generator designating information into performance data. Let it be assumed here that the special-type tone generator of FIG. 2 is used as the rendition-style-compliant tone generator in the electronic musical instrument.

At step S1, a rendition-style-corresponding portion and a particular type of a rendition style represented by that portion are detected from among performance data for that ordinary-type tone generator. For that purpose, detection is made, for example, of a rendition-style-corresponding portion which is composed of two successive notes having a "very short note length" and "long note length", respectively, and having a tone pitch difference equal to or smaller than two half steps, and the type of the rendition style represented by the detected rendition-style-corresponding portion is detected as a "slide rendition style". Also, detection is made of a rendition-style-corresponding portion where the tone pitch varies upwardly and downwardly periodically (specifically, where periodically-varying pitch bend data is present in the performance data), and the type of the rendition style represented by the detected rendition-style-corresponding portion is detected as a "vibrato rendition style". If such a rendition-style-corresponding portion and rendition style type have not been detected (NO determination at step S2), original velocity data, i.e. velocity data in the performance data for the ordinary-type tone generator, is converted at step S5, so that the velocity data in the performance data for the ordinary-type tone generator is replaced with the converted velocity data at step S6, to thereby create performance data for the special-type tone generator. Namely, because, as noted earlier, the velocity data used in the ordinary-type tone generator are each normally intended to represent a larger tone volume of a tone signal as its value increases while the velocity data used in the special-type tone generator are each normally intended to specify waveform data corresponding to any one of a plurality of special-type tone colors based on different rendition styles, the velocity data in the performance data for the ordinary-type tone generator can not be used as-is in the performance data for the special-type tone generator. For this reason, the original velocity data are converted into velocity data values of a predetermined range which are allocated to rendition styles corresponding to the ordinary-type tone generator. For example, velocity data that is set, in the performance data for the ordinary-type tone generator, within a range of "1-127" and that has a characteristic as represented by a broken line of FIG. 2B is converted into velocity data that is set within a range of "1-45" and has a characteristic as represented by solid lines of FIG. 2B. Thus, for each portion of the performance data which has not been detected as a rendition-style-corresponding portion, tone volume control similar to that performed in the ordinary-type tone generator can be performed in the special-type tone generator.

If, on the other hand, a rendition-style-corresponding portion and rendition style type have been detected (YES determination at step S2), the detected rendition-style-corresponding portion is changed, at step S3, to "non-rendition-style-correspondent" performance data that, unlike the performance data of the ordinary-type tone generator, has no musical structure for reproducing a rendition style. Also, rendition-style-compliant tone generator designating information, corresponding to the detected rendition style type, is written into a relevant portion of the performance data, at step S4. Specifically, as illustrated in FIG. 4, this operation for writing the rendition-style-compliant tone generator designating information converts the original velocity to a velocity of the detected rendition style with reference to a velocity conversion table (step S11), and then the velocity data in the performance data for the ordinary-type tone generator is replaced with the converted velocity data (step S12). Such automatic conversion of the performance data for the ordinary-type tone generator to the performance data for the special-type tone generator will be later described in greater detail with reference to FIG. 7 or 8.

Note that details or contents of the above-mentioned operation for writing the rendition-style-compliant tone generator designating information (step S4 of FIG. 3) differs between rendition-style-compliant tone generators. The process of FIG. 4 has been described as performed in the case where the special-type tone generator of FIG. 2 is employed as a rendition-style-compliant tone generator; however, a tone generator with a different tone color allocated to each rendition style may be employed as a rendition-style-compliant tone generator. Thus, the following paragraphs describe another example of the "process for writing rendition-style-compliant tone generator designating information" with reference to a flow chart of FIG. 5.

Figure 5:
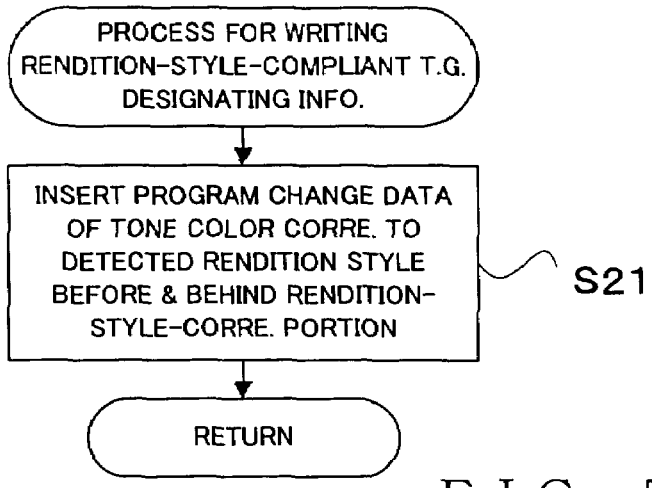
FIG. 5 is flow chart showing another example of the process for writing rendition-style-compliant tone generator designating information into performance data.

In the process illustrated in FIG. 5, program change data of a tone color corresponding to a detected rendition style are inserted in the performance data before and behind a rendition-style-corresponding portion, at step S21. Namely, the program change data inserted before the rendition-style-corresponding portion instructs that a rendition-style-compliant tone generator should be used, while the program change data inserted behind the rendition-style-corresponding portion instructs that an ordinary-type tone generator should be used. Namely, by placing the program change data before and after a data section to be changed, the process of FIG. 5 designates and cancels a tone color map of the special-type tone generator to be used. In this way, it is possible to create performance data for the special-type tone generator by changing only part of the performance data for the ordinary-type tone generator, without altering the entire performance data for the ordinary-type tone generator as in the above-described example. Therefore, the operations of steps S5 and S6 in the "performance data generation processing" (FIG. 3) are omitted, because there is no need to change the velocity data.

Figure 6:
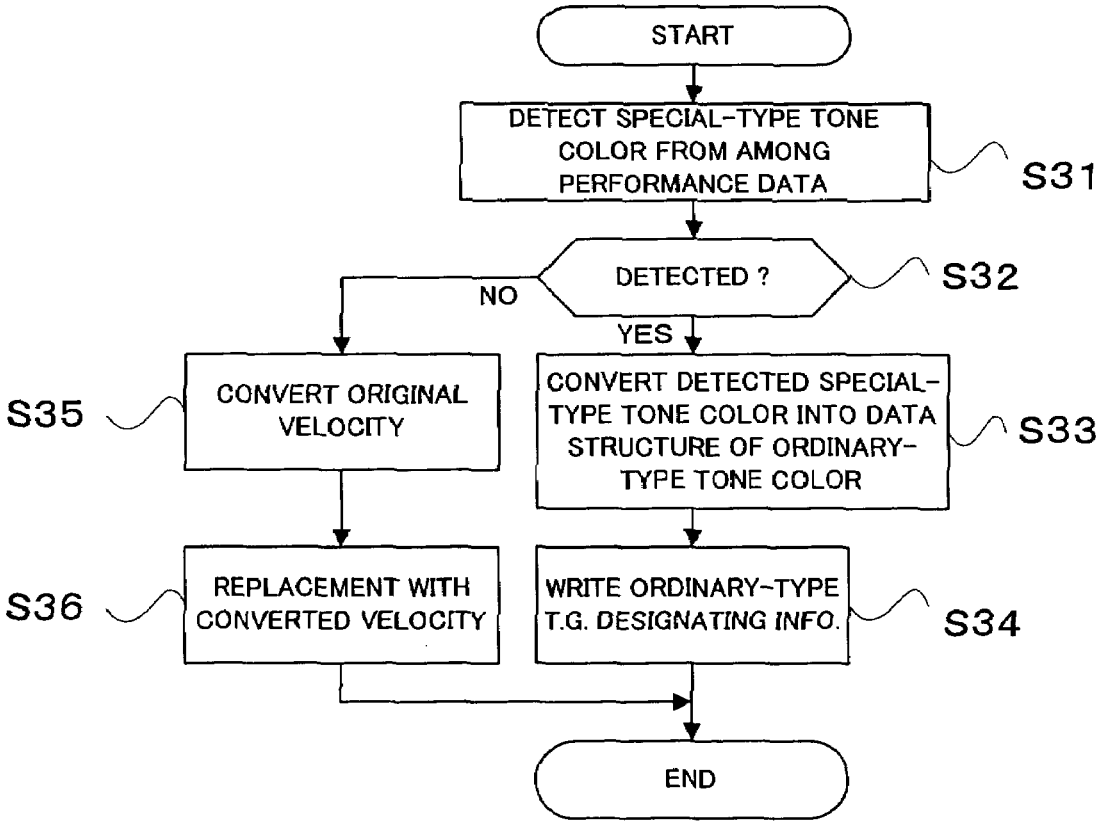
FIG. 6 is a flow chart showing an example of performance data creation processing performed when the tone generator to be used in the electronic musical instrument has been changed from a rendition-style-compliant tone generator over to an ordinary-type tone generator.

Next, the "performance data generation processing" will be described in relation to a case where it creates performance data for an ordinary-type tone generator using performance data for a special-type tone generator. FIG. 6 is a flow chart showing another example of the "performance data creation processing" performed when the tone generator in the electronic musical instrument has been changed from a rendition-style-compliant tone generator over to an ordinary-type tone generator. Let it be assumed here that, in this case too, the special-type tone generator of FIG. 2 is used as the rendition-style-compliant tone generator in the electronic musical instrument.

At step S31, a special-type tone color is detected from among the performance data for the special-type tone generator. For example, this step detects, as a special-type tone color, a portion where is defined rendition-style-compliant tone generator designating information corresponding to a rendition style type (such as a velocity data value or predetermined program change data value corresponding to a special-type tone color). If such a rendition-style-corresponding portion and rendition style type have not been detected (NO determination at step S2), original velocity data, i.e. velocity data in the performance data for the special-type tone generator, is converted at step S35 and the velocity data in performance data for the special-type tone generator is replaced with the converted velocity data at step S36, to thereby create performance data for the ordinary-type tone generator. Namely, contrary to the operations carried out at steps S5 and S6 of the processing described above in relation to FIG. 3, the original velocity data is changed to a velocity data value of the ordinary-type tone generator. If, on the other hand, a special-type tone color has been detected (YES determination at step S32), the detected special-type tone color is converted into a data structure of a corresponding ordinary-type tone color at step S33, and then ordinary-type tone color designating information is written at step S34. Rules (such as an algorithm or template) regarding the data structure of the corresponding ordinary-type tone color is pre-defined for each special-type tone color, and the data structure of the ordinary-type tone color described by the ordinary-type tone generator designating information defined by these rules is inserted into the relevant rendition-style-corresponding portion.

Figure 7A:
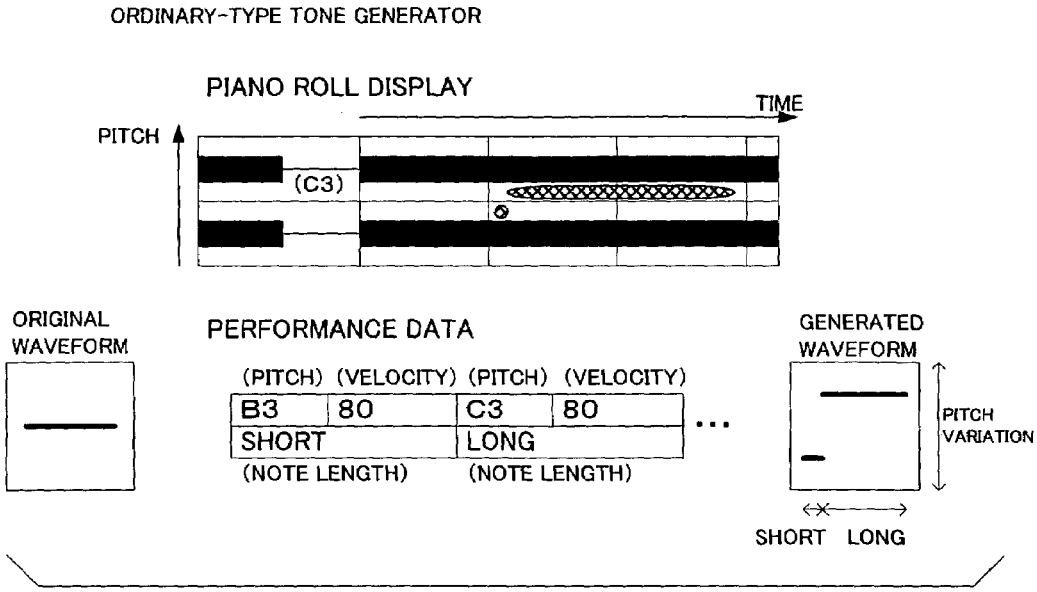
FIGS. 7A and 7B are conceptual diagrams explanatory of the performance data creation processing in connection with a slide rendition style.
Figure 7B:
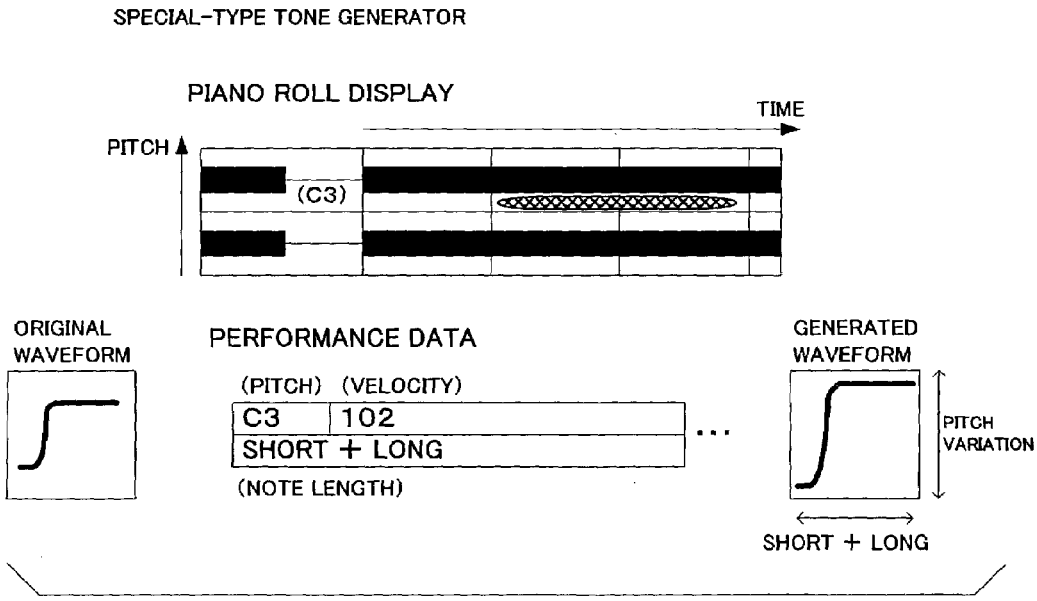
Figure 8A:
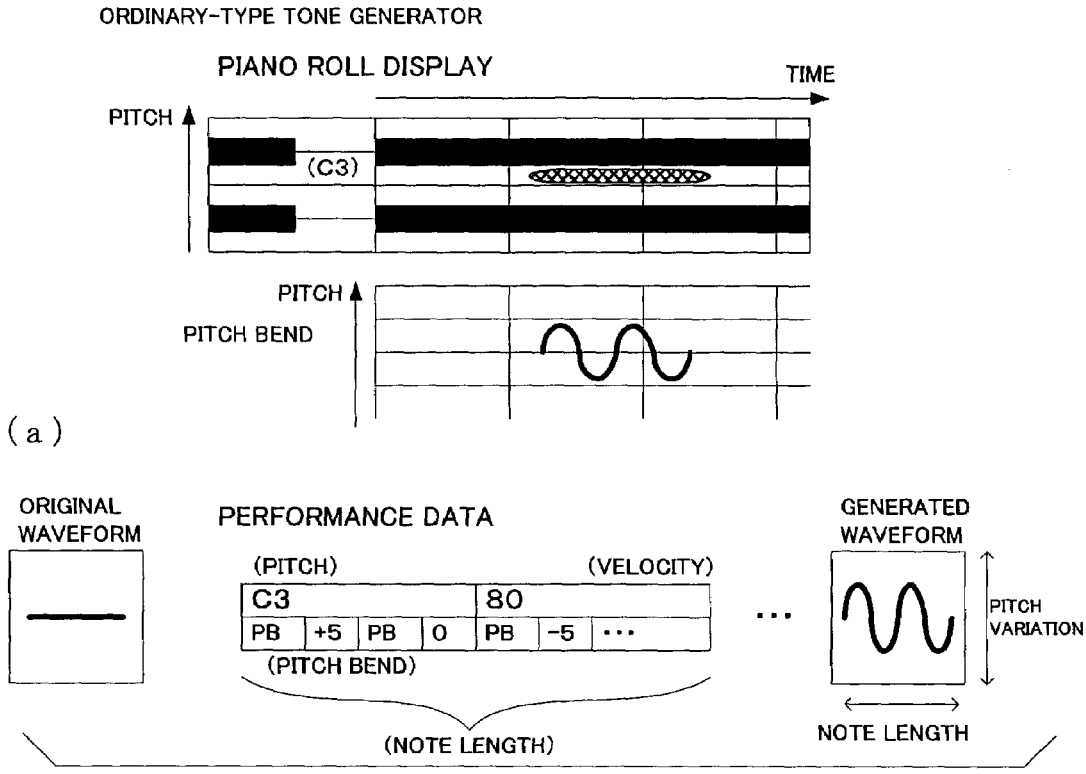
FIGS. 8A and 8B are conceptual diagrams explanatory of the performance data creation processing in connection with a vibrato rendition style.
Figure 8B:
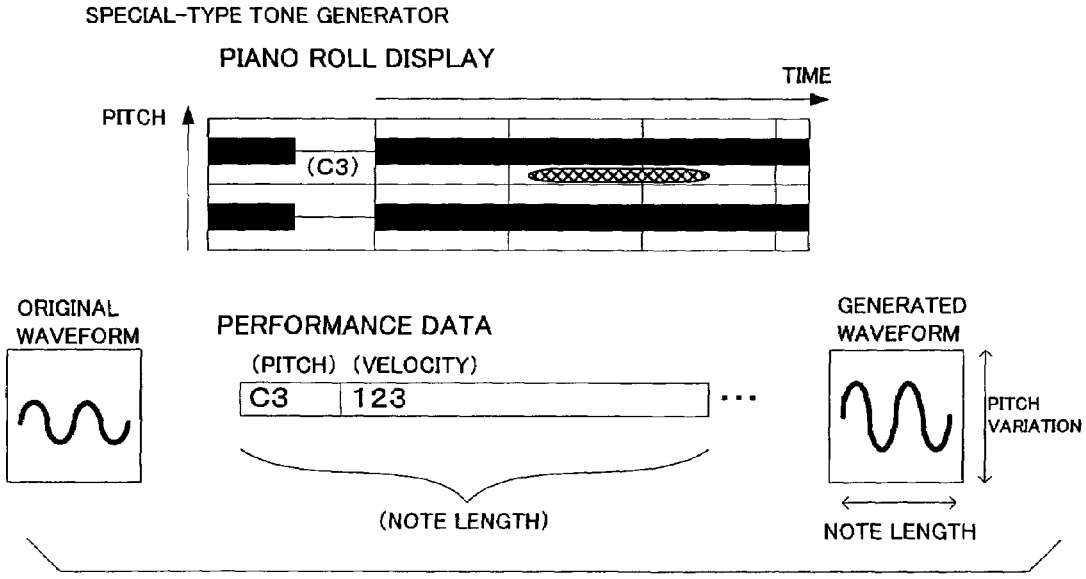

The "performance data generation processing" is described below using specific examples of rendition styles. Namely, the performance data generation processing is described in connection with a slide rendition style with reference to FIG. 7, and in connection with a vibrato rendition style with reference to FIG. 8. FIGS. 7A and 8A illustrate performance data for an ordinary-type tone generator that correspond to the rendition styles, while FIGS. 7B and 8B illustrate performance data for a special-type tone generator that correspond to the rendition styles. To facilitate understanding of differences between the performance data for the ordinary-type tone generator and the performance data for the special-type tone generator, each of the figures shows, in addition to the structure or organization of the performance data for the tone generator, a piano roll that indicates tones, performed on the basis of the performance data, on a piano keyboard (having black and white keys) displayed on the display device 6A while sequentially developing the tones over time, an original waveform read out on the basis of the performance data, and a waveform generated on the basis of the performance data.

The performance data illustrated in FIG. 7A, comprising combinations of tone pitches and velocities and lengths of individual notes, are data of a particular portion corresponding to a slide rendition style where note events "B3" and "C3" are arranged stepwise as indicated by the piano roll display. If the original waveform is read out and reproduced using the performance data, there is generated a stepwise waveform comprising a tone pitch (B3) of a short note length and a tone pitch (C3) of a long note length. Namely, the performance data illustrated in FIG. 7A are data having a musical structure for reproducing a rendition style where the long-length note, indicated by a horizontally-elongated shaded portion on the piano roll display, is an ornamented note of a tone pitch (C3) and the note of an extremely short length, indicated by a shaded dot on the piano roll display, is an ornamental note generated at a pitch (B3) lower by a half step than the ornamented note; that is, the performance data has a musical structure for reproducing a slide rendition style.

If a rendition-style-corresponding portion and rendition style type have been detected, through execution of the "performance data generation processing" (see FIG. 3), from among the performance data for the ordinary-type tone generator, the detected rendition-style-corresponding portion is changed to "non-rendition-style-correspondent" performance data; for example, the portion corresponding to the slide rendition style is deleted. Then, rendition-style-compliant tone generator designating information, which newly designates a slide rendition style waveform for the deleted portion, is written into the performance data. In this manner, performance data for the special-type tone generator are newly created as illustrated in FIG. 7B. Namely, as rendition-style-compliant tone generator designating information, there are created performance data, corresponding to a slide rendition style, for the special-type tone generator, where the tone pitch has been set to the pitch "C3" of the ornamented note, the velocity data value for designating a waveform corresponding to a slide rendition style has been set to "102" (see FIG. 2B) and the note length has been set to a sum of the respective lengths (i.e., "short+long" lengths) of the ornamented and ornamental notes. Unlike the performance data for the ordinary-type tone generator, the performance data for the special-type tone generator are data having no musical structure for reproducing a slide rendition style. If the created performance data are displayed in the piano roll format, only the long-length note is displayed as indicated by a horizontally-elongated shaded portion. By reproducing the created performance data, there can be reproduced a slide rendition style where the pitch changes abruptly from the tone pitch (B3) of the short-length note to the pitch (C3) of the long-length note as illustrated by the "created waveform".

Next, the performance data generation processing is described in connection with a vibrato rendition style with reference to FIG. 8. The performance data illustrated in FIG. 8A, comprising combinations of tone pitches and velocities and pitch bend variation (in this case, the note lengths are indicated by performance data lengths, for convenience sake), are data of a particular portion corresponding to a vibrato rendition style where a long-length note as indicated by a horizontally-elongated shaded portion is displayed only for the note event "C3" and a pitch bend variation is displayed by the piano roll display. If the original waveform is read out and reproduced using the performance data, there is generated a waveform where the tone pitch varies periodically as indicated by a "generated waveform" block in the figure. Namely, the performance data illustrated in FIG. 8A are data having a musical structure for reproducing a vibrato rendition style.

If a rendition-style-corresponding portion and rendition style type have been detected, through execution of the "performance data generation processing" (see FIG. 3), from among the performance data for the ordinary-type tone generator, the detected rendition-style-corresponding portion is changed to "non-rendition-style-correspondent" performance data; for example, the pitch bend data may be deleted. Then, rendition-style-compliant tone generator designating information, which newly designates a vibrato rendition style waveform for the deleted portion, is written into the performance data. In this manner, performance data for the special-type tone generator are newly created as illustrated in FIG. 8B. Namely, as rendition-style-compliant tone generator designating information, there are created performance data, corresponding to a vibrato rendition style, for the special-type tone generator, where the tone pitch has been set to the pitch "C3" and the velocity data value for designating a waveform corresponding to a vibrato rendition style has been set to "123" (see FIG. 2B) but the note lengths are left unchanged. If the thus-created performance data are displayed in the piano roll format, only the long-length note is displayed as indicated by a horizontally-elongated shaded portion and the pitch bend variation is not displayed. By reproducing the created performance data, there can be reproduced a vibrato rendition style where the pitch changes periodically as indicated by a "generated waveform" block in FIG. 8B.

Needless to say, if the "performance data generation processing" (see FIG. 6) is performed using the performance data for the special-type tone generator of FIG. 7B or 8B as the original performance data, there can be created the performance data for the ordinary-type tone generator as illustrated in FIG. 7A or 8A.

It should also be understood that the rendition-style-corresponding portion and rendition style to be detected from among the performance data may be other than the slide or vibrato rendition style as set forth above. Further, because the rendition style type generally differs among various musical instruments (i.e., among various tone colors), it is desirable to identify of what musical instrument the performance data to be examined for a rendition style are, and then determine a rendition style type to be detected in accordance with the identified result.

Also note that, whereas the performance data generation processing responsive to a changeover in the tone generator has been described as performed fully automatically, it may be performed semi-automatically. For example, when a rendition-style-corresponding portion has been detected, the user may be queried about whether the detected rendition-style-corresponding portion should be sounded by the rendition-style-compliant tone generator, and, only if the user has answered affirmatively (i.e., answered that the detected rendition-style-corresponding portion should be sounded by the rendition-style-compliant tone generator), that portion may be converted into performance data for the rendition-style-compliant tone generator. Further, only a designated portion (e.g., only a designated timewise portion or only a designated performance part) of a music piece may be converted into performance data for the rendition-style-compliant tone generator.

Furthermore, in a case where the rendition-style-compliant tone generator is also capable of handling any of rendition style parameters, such as a slide speed and vibrato speed and depth, arrangements may be made for detecting the rendition style parameter during detection, from among the ordinary-type performance data, a rendition-style-corresponding portion and then recording the detected rendition style parameter in the rendition-style-compliant performance data.

Moreover, whereas the preferred embodiment has been described in relation to the case where, as a special-type tone color (rendition-style-dependent tone color), different tone colors (rendition styles) are mapped in the velocity direction and note number direction (see FIG. 2), different tone colors may be mapped in only one of the velocity direction and note number direction, or in any other desired manner. Because the special-type tone color differs in characteristic from the ordinary-type tone color, the present may be applied to any special-type tone colors for which there is a need to create performance data in accordance with the tone color characteristics.

In the case of a PCM tone generator, it just suffices to prepare waveform data per rendition style, in order to provide a rendition-style-compliant tone generator. Further, in the case of an FM, physical model, formant tone generators, etc., it suffices to prepare tone synthesis parameters and tone synthesis algorithm per rendition style.

It should also be understood that the performance data to be used in the invention may be in any desired format, such as: the "event plus relative time" format where the time of occurrence of each performance event is represented by a time length from the immediately preceding event; the "event plus absolute time" format where the time of occurrence of each performance event is represented by an absolute time within the music piece or a measure thereof; the "pitch (rest) plus note length" format where each performance data is represented by a pitch and length of a note or a rest and a length of the rest; or the "solid" format where a memory region is reserved for each minimum resolution of a performance and each performance event is stored in one of the memory regions that corresponds to the time of occurrence of the performance event.

What is claimed is:

1. A performance data processing apparatus comprising:

a performance data acquisition section that acquires performance data of a first type including one or more kinds of tone control data, the performance data of said first type having a data structure predefined for use in a first-type tone generator, said one or more kinds of tone control data being used in the first-type tone generator to generate a tone signal representative of a rendition style;

a detection section that detects a particular portion of the one or more kinds of tone control data, the particular portion corresponding to a predetermined rendition style; and a data conversion section that converts the particular portion of the one or more kinds of tone control data into rendition-style designating data and reforms the performance data of said first type as performance data of a second type including the converted rendition-style designating data, the performance data of said second type having a data structure predefined for use in a second-type tone generator, said converted rendition-style designating data being used to generate a tone signal representative of the rendition style.

2. A performance data processing apparatus as claimed in claim 1, wherein said first-type tone generator is incapable of tone generation corresponding to rendition-style designating data, and wherein said second-type tone generator is capable of tone generation corresponding to rendition-style designating data.

3. A performance data processing apparatus as claimed in claim 1 wherein said data conversion section changes a state of the tone control data in the performance data of said first type to be reformed into a state where the predetermined rendition style is not present and then adds, to the performance data of said first type including the tone control data having a changed state, the converted rendition-style designating data specifying to thereby reform the performance data of said first type as the performance data of said second type including the converted rendition-style designating data.

4. A performance data processing apparatus as claimed in claim 3 wherein change, by said data conversion section, of the state of the tone control data includes changing a value of the tone control data to be reformed.

5. A performance data processing apparatus as claimed in claim 3 wherein, when a plurality of performance events are included in a portion of the performance data which corresponds to the tone control data to be reformed change, by said data conversion section, of the state of the control data by reducing the number of the performance events.

6. A performance data processing apparatus as claimed in claim 1, wherein said data conversion section reforms the performance data of said first type as the performance data of said second type, by changing a value of velocity data included in the tone control data in the performance data of said first type to be reformed, and wherein, in the performance data of said second type, a predetermined scope of values that can be taken by the velocity data for a particular tone color is divided into a plurality of ranges so that, for each of the plurality of ranges, the velocity data indicates a different rendition style of the particular tone color, whereby the range to which a current value of the velocity data in the performance data of said second type belongs corresponds to the rendition-style designating data.

7. A performance data processing apparatus as claimed in claim 1, wherein, in the performance data of said second type, each of a plurality of rendition styles has a different rendition-style-corresponding tone color number, and wherein, with respect to the tone control data in the performance data of said first type to be reformed, said data conversion section adds information indicative of the rendition-style-corresponding tone color number representative of the predetermined rendition style, so that performance data of said second type including, as the rendition-style designating data, the added information indicative of the rendition-style-corresponding tone color number are created.

8. A performance data processing apparatus comprising:

a performance data acquisition section that acquires performance data of a first type including rendition-style designating data for specifying a predetermined rendition style, the performance data of said first type having a data structure predefined for use in a first-type tone generator, said one or more kinds of tone control data being used in the first-type tone generator to generate a tone signal representative of a rendition style;

a detection section that detects said rendition-style designating data included in the performance data of said first type acquired by said performance data acquisition section; and a data conversion section that converts the rendition-style designating data, detected by said detection section, into one or more kinds of tone control data to be used for reproducing the predetermined rendition style specified by the rendition-style designating data and reforms the performance data of said first type as performance data of a second type including the converted one or more kinds of tone control data, the performance data of said second type having a data structure predefined for use in a second-type tone generator, said converted rendition-style designating data being used to generate a tone signal representative of the rendition style.

9. A performance data processing apparatus as claimed in claim 8, wherein said first-type tone generator is capable of tone generation corresponding to rendition-style designating data, and wherein said second-type tone generator is incapable of tone generation corresponding to rendition-style designating data.

10. A performance data processing apparatus as claimed in claim 8 wherein conversion, by said data conversion section, of the detected rendition-style designating data into the one or more kinds of tone control data includes changing a value of tone control data in a portion of the performance data of said first type which corresponds to the rendition-style designating data.

11. A performance data processing apparatus as claimed in claim 8 wherein, when a performance event is included in a portion of the performance data of said first type which corresponds to the rendition-style designating data, conversion, by said data conversion section, of the detected rendition-style designating data into the one or more kinds of tone control data includes increasing the number of the performance event.

12. A performance data processing apparatus as claimed in claim 8 wherein, in the performance data of said first type, a predetermined scope of values that can be taken by velocity data for a particular tone color is divided into a plurality of ranges so that, for each of the plurality of ranges, the velocity data indicates a different rendition style of the particular tone color, whereby the range to which a current value of the velocity data in the performance data of said first type belongs corresponds to the rendition-style designating data, wherein said detection section detects the rendition-style designating data from velocity data in the acquired performance data of said first type, and wherein, for the performance data of said first type, said data conversion section converts velocity data including the rendition-style designating data to ordinary velocity data including no rendition-style designating data and also adds tone control data to be used for reproducing the predetermined rendition style specified by the rendition-style designating data, to thereby reform the performance data of said first type as the performance data of said second type.

13. A performance data processing apparatus as claimed in claim 8 wherein, in the performance data of said first type, each of a plurality of rendition styles has a different rendition-style-corresponding tone color number, and information indicative of the rendition-style-corresponding tone color number representative of the predetermined rendition style is added as the rendition-style designating data, and wherein said data conversion section reforms the performance data of said first type as the performance data of said second type by adding, in place of the information indicative of the rendition-style-corresponding tone color number in the performance data of said first type, tone control data to be used for reproducing the predetermined rendition style specified by the rendition-style designating data.

14. A performance data processing method comprising:

acquiring performance data of a first type including one or more kinds of tone control data, the performance data of said first type having a data structure predefined for use in a first-type tone generator, said one or more kinds of tone control data being used in the first-type tone generator to generate a tone signal representative of a rendition style;

detecting a particular portion of the one or more kinds of tone control data, the particular portion corresponding to a predetermined rendition style; and converting the particular portion of the one or more kinds of tone control data into rendition-style designating data and reforming the performance data of said first type as performance data of a second type including the converted rendition-style designating data, the performance data of said second type having a data structure predefined for use in a second-type tone generator, said converted rendition-style designating data being used to generate a tone signal representative of the rendition style.

15. A computer-readable storage medium storing a program for causing a computer to perform:

a step of acquiring performance data of a first type including one or more kinds of tone control data, the performance data of said first type having a data structure predefined for use in a first-type tone generator, said one or more kinds of tone control data being used in the first-type tone generator to generate a tone signal representative of a rendition style;

a step of detecting a particular portion of the one or more kinds of tone control data, the particular portion corresponding to a predetermined rendition style; and a step of converting the particular portion of the one or more kinds of tone control data into rendition-style designating data and reforming the performance data of said first type as performance data of a second type including the converted rendition-style designating data, the performance data of said second type having a data structure predefined for use in a second-type tone generator, said converted rendition-style designating data being used to generate a tone signal representative of the rendition style.

16. A performance data processing method comprising:

acquiring performance data of a first type including rendition-style designating data for specifying a predetermined rendition style, the performance data of said first type having a data structure predefined for use in a first-type tone generator, said one or more kinds of tone control data being used in the first-type tone generator to generate a tone signal representative of a rendition style;

detecting said rendition-style designating data included in the acquired performance data of said first type; and converting the detected rendition-style designating data into one or more kinds of tone control data to be used for reproducing the predetermined rendition style specified by the rendition-style designating data and reforming the performance data of said first type as performance data of a second type including the converted one or more kinds of tone control data, the performance data of said second type having a data structure predefined for use in a second-type tone generator, said converted rendition-style designating data being used to generate a tone signal representative of the rendition style.

17. A computer-readable storage medium storing a program for causing a computer to perform:

a step of acquiring performance data of a first type including rendition-style designating data for specifying a predetermined rendition style, the performance data of said first type having a data structure predefined for use in a first-type tone generator to generate a tone signal representative of a rendition style;

a step of detecting said rendition-style designating data present in the acquired performance data of said first type; and a step of converting the detected rendition-style designating data into one or more kinds of tone control data to be used for reproducing the predetermined rendition style specified by the rendition-style designating data and reforming the performance data of said first type as performance data of a second type including the converted one or more kinds of tone control data, the performance data of said second type having a data structure predefined for use in a second-type tone generator, said converted rendition-style designating data being used to generate a tone signal representative of the rendition style.

* * * * *